United States Patent [19]

Hunter

[11] Patent Number: 4,469,936

[45] Date of Patent: Sep. 4, 1984

[54] HEATING ELEMENT SUITABLE FOR ELECTRIC SPACE HEATERS

[75] Inventor: James B. Hunter, Newton Square, Pa.

[73] Assignee: Johnson Matthey, Inc., Malvern, Pa.

[21] Appl. No.: 487,759

[22] Filed: Apr. 22, 1983

[51] Int. Cl.[3] ..... H05B 3/16

[52] U.S. Cl. ..... 219/543; 29/90 R; 29/620; 204/36; 338/309; 338/314; 219/375; 219/537

[58] Field of Search ..... 219/522, 533, 543, 553, 219/375, 376; 204/36; 106/3; 29/89.5, 90 R, 90.2, 90.3, 620; 338/306, 307, 308, 309, 312, 314, 327

[56] References Cited

U.S. PATENT DOCUMENTS

| | | | |
|---|---|---|---|
| 2,795,683 | 6/1957 | Teiger | 219/537 X |
| 3,669,907 | 6/1972 | Kohashi et al. | 252/518 |
| 3,734,837 | 5/1973 | Blair et al. | 204/36 |
| 3,843,495 | 10/1974 | Malak | 204/36 X |
| 3,978,316 | 8/1976 | Rose et al. | 219/543 |
| 4,087,778 | 5/1978 | Merz et al. | 338/309 |
| 4,172,922 | 10/1979 | Merz et al. | 428/432 |
| 4,174,513 | 11/1979 | Wellard | 338/314 X |
| 4,286,251 | 8/1981 | Howell | 338/309 |
| 4,298,856 | 11/1981 | Schuchardt | 338/308 X |

FOREIGN PATENT DOCUMENTS

| | | | |
|---|---|---|---|
| 132933 | 8/1982 | Japan | 29/90 R |

*Primary Examiner*—Volodymyr Y. Mayewsky
*Attorney, Agent, or Firm*—Cushman, Darby & Cushman

[57] ABSTRACT

A heat generating element particularly well suited for use in an electrical space heater and method of making same include an electrically nonconductive substrate on which is coated a layer of an electrically nonconductive ceramic material having finely divided, micron size metallic particles dispersed therein. A path of electrical conductivity is established in the otherwise nonconductive ceramic material by burnishing the surface of the ceramic material between two separated points. Thus, as electrical current flows along the burnished path, heat will be generated due to the electrical resistance thereof.

11 Claims, 3 Drawing Figures

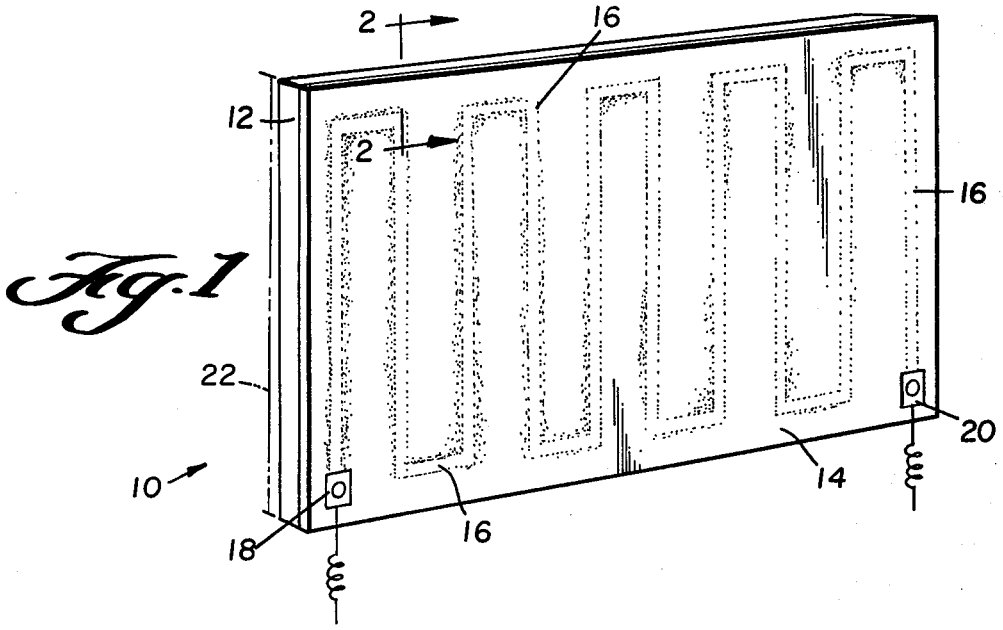
Fig. 1
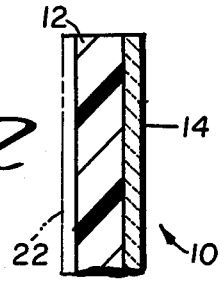
Fig. 2
Fig. 3
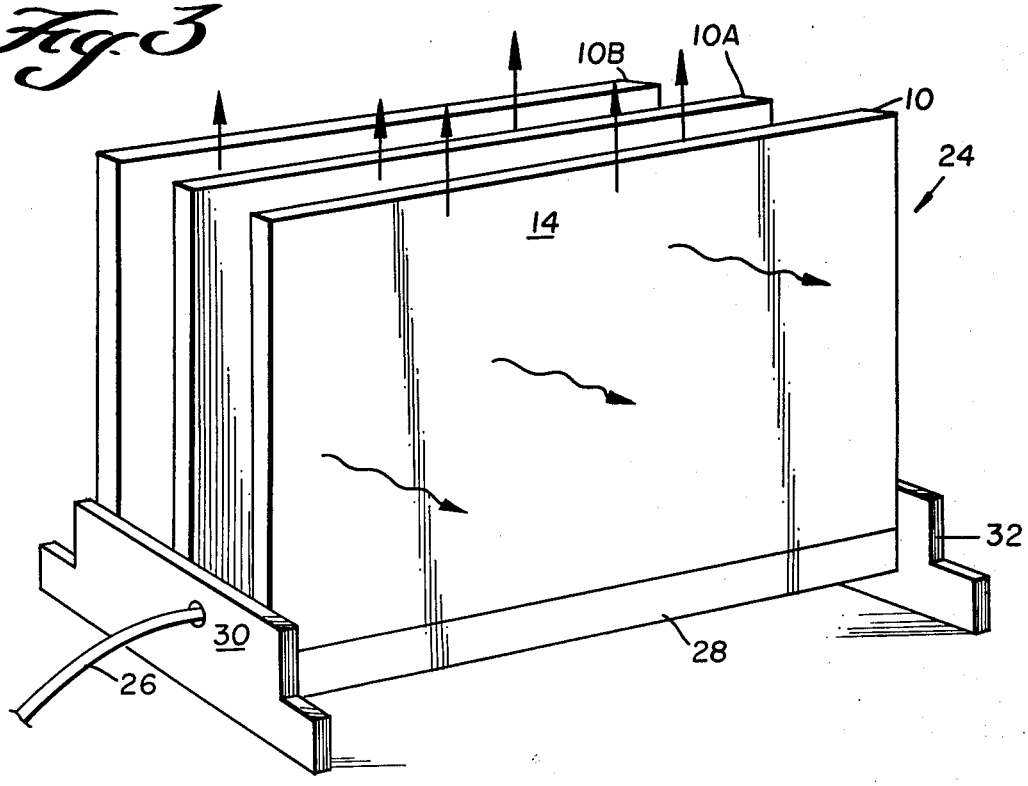

HEATING ELEMENT SUITABLE FOR ELECTRIC SPACE HEATERS

BACKGROUND AND SUMMARY OF THE PRESENT INVENTION

The present invention generally relates to electric space heaters which radiate heat energy and thus warm a particular space, room, etcetera. More particularly, the present invention is directed to a novel electric space heater having at least one element which includes an otherwise electrically nonconductive ceramic coating having a burnished path thereon to surprisingly render the ceramic coating electrically conductive along such path. Thus, as electrical current flows along the path, heat is distributed over the surface of the element which is dissipated to the environment by radiation and convection.

With the recent escalation of fuel costs used for heating homes, offices and the like, consumers have continually sought improved means for reducing the ever increasing cost spiral of conventional fuels utilized for home heating purposes, such as, heating oil, natural gas, and/or electricity. The burden of paying such increased fuel heating costs has become acute, particularly during winter months and to make matters worse, no relief in the form of reduced fuel costs is evident in the foreseeable future.

One primary manner in which consumers can combat escalating fuel costs is through conservation. Thus, it has become evident that an entire home, for example, does not need to be heated to the desirable temperature of 72° F. and many consumers now maintain the temperatures within their homes between about 65° F. to 68° F. Moreover, some consumers further conserve the heat from their central heating system by blocking off unused or seldom used spaces or rooms in their homes. In such a manner, the heat produced by the central heating system will be efficiently utilized in maintaining a comfortable environment within those spaces or rooms most frequently occupied.

Space heaters are a convenient means for providing localized heating of a small space and, due to the increased fuel costs mentioned above, have been achieving increased popularity among consumers in recent years as a low cost alternative to the "whole house" or centralized concept of heating. Thus, space heaters can be utilized as a supplement to the conservation techniques briefly alluded to above, or can provide localized heating of selected spaces or rooms within the consumer's home as an alternative to centralized heating. In either case, significant savings in fuel costs can be realized through the use of space heaters.

Space heaters are, in and of themselves, well known and are typically a "fired" type which utilize organic fuels such as natural gas, kerosene, liquified petroleum gas, and the like or are electrically operated. The latter type of space heaters typically utilize a conductive coil wire or a wire heating element through which electrical current flows. Due to the electrical resistance of the conductive heating elements, the electrical energy is at least partially transformed to heat which through radiation, convection or the like, is transferred to the environment thereby warming it.

The present invention is directed to the genre of electrical space heaters in that electrical energy is utilized as a source for obtaining heat energy. However, according to the present invention, rather than utilizing conducting elements, such as heavy gauge wire or the like, a coating of nonconductive ceramic material is utilized and is selectively rendered conductive by burnishing a path along which electrical current will flow. Thus, as electrical current flows along the path and is converted to heat energy due to the resistance thereof, the heat energy will be distributed substantially evenly on the surface of the ceramic material and dissipated to its surrounding environment by radiation and/or convection.

These and other objects and advantages of the present invention will become more apparent after careful consideration is given to the detailed description of the preferred exemplary embodiment thereof which follows.

BRIEF DESCRIPTION OF THE ACCOMPANYING DRAWINGS

Reference will hereinafter be made to the accompanying drawings wherein like reference numerals throughout the various Figures denote like structural elements and wherein:

FIG. 1 is a perspective view of an exemplary heating element in accordance with the present invention;

FIG. 2 is a cross-sectional view of an exemplary heating element of the present invention taken along line 2—2 in FIG. 1; and FIG. 3 is a perspective view of an assembled space heater having a plurality of heating elements in accordance with the present invention.

DETAILED DESCRIPTION OF THE PREFERRED EXEMPLARY EMBODIMENT

Attention is directed to accompanying FIG. 1 wherein a particularly preferred heating element 10 is shown in perspective view. Element 10 is preferably planar but other geometric shapes (e.g., cylindrical, arcuate or the like) are well within the contemplation of the present inventon.

Element 10 includes an electrically insulative rigid substrate 12 having at least one of its surfaces coated with a layer 14 of ceramic material (see FIG. 2). Substrate 12 can be any material having electrically insulative (e.g., nonconducting) properties and which can withstand elevated temperatures up to about 350° F. or greater. Preferred materials of construction for substrate 12 include Masonite, high temperature plastics, glass, plaster board, cement, sheet rock, alumina, ceramics, sheet metal coated with an electrically insulating material, and the like. For example, electrically insulative substrate can be a ceramic material formed from "ALSEAL 502" commercially available from Coatings For Industries, Inc.

Layer 14 is an extremely important aspect of the present invention as I have surprisingly discovered that an otherwise electrically nonconductive ceramic material having finely divided metallic particles dispersed therein can be rendered electrically conductive by burnishing the surface thereof.

By the term "burnishing" or like terms, I mean to refer to the effect upon a surface when such surface is rubbed so as to smooth, polish, render glossy and/or enhance the luster thereof. Preferably, the ceramic material is "burnished" by contacting the surface with a rotating polishing wheel, such as, a wire brush wheel.

Thus, the nonconductive ceramic material comprising layer 14 can be selectively rendered electrically conductive by burnishing a continuous path on its surface between two separated points. As shown in FIG. 1, path 16 is burnished in a meandering fashion on the surface of layer 14 between a first electrical contact 18 and a second electrical contact 20. Thus when contacts 18, 20 are connected to a source of electrical energy (preferably 115 V.A.C.), electrical communication is established along path 16 and the resistance provided thereby generates heat as already mentioned above.

The term "ceramic material" as used herein describes a ceramic binder material which when coated upon a substrate similar to that described above and fired at a temperature of at least about 350° F. exhibits a strong, crack free ceramic with a high heat transfer conductivity and includes a dispersion therein of finely divided or micron size metallic particles. Several binder solutions are commercially available which can satisfactorily be utilized in accordance with the present invention. One such binder solution is "ALSEAL 500", a proprietary binder solution that may be commercially obtained from Coatings For Industries, Inc. "ALSEAL 500" is a dispersion of finely divided aluminum powder in an aqueous binder solution containing aluminum phosphate, a soluble chromium compound, and an organic amine compound as a surface active agent. This product is sold primarily as a metal coating preparation designed to protect the surface of metals operating under oxidizing conditions at high temperatures, such as, for example, the coating of aircraft turbine blades. In this regard, see U.S. Pat. No. 4,169,099 the disclosure of which is hereby incorporated by reference.

I have surprisingly found that when the above ceramic material, fired at a temperature of at least 350° F. is burnished, an electrically conductive path is established along such burnished path. It is surmised that when such ceramic material is burnished, the metallic particles, which are otherwise dispersed therein, are smeared across one another to render the burnished path electrically conductive due to the electrically conductive nature of the metallic particles. Those in the ceramic art may recognize other suitable ceramic materials which can be advantageously utilized in accordance with the present invention. Thus, the reader should appreciate that the description of the above-noted ceramic material represents a particularly preferred embodiment of the present invention and is non-limiting with respect thereto.

The thickness of layer 14 is not critical although when consideration is given to the fact that a burnishing wheel may be utilized to establish path 16, layer 14 should be of sufficient thickness to prevent exposure of substrate 12 along path 16 so as to prevent electrical "dead spots" therein. Layer 14 can be applied to substrate 12 by any conventional technique believed to be well known to those in the ceramic coating art and can include techniques such as spraying, brushing, dipping or rolling. The thus applied layer 14 will have the appearance of dull aluminum paint, when "ALSEAL 500" is utilized after firing to a temperature of at least 350° F.

Substrate 12 can have both surfaces coated with a layer of ceramic material if this is desired. Thus, in addition to layer 14, layer 22 (noted in phantom line in FIGS. 1 and 2) can be provided on substrate 12, in which case a burnished path can also be provided on its surface in manner similar to that described above.

A space heater 24 is depicted in FIG. 3 as comprising three heating elements 10, 10A and 10B, although more or less heating elements may comprise space heater 24 if desired. Elements 10A and 10B are preferably identical to element 10 described above. Thus each of the burnished paths (not shown in FIG. 3 for clarity of presentation) of elements 10, 10A and 10B can be electrically connected to a source of electrical energy, such as a conventional convenience outlet (not shown), by a standard cord 26 and male plug (not shown). Frame 28 having leg members 30, 32 preferably mount planar elements 10, 10A and 10B substantially parallel with respect to one another so as to permit air circulation therebetween to dissipate the heat generated by members 10, 10A and 10B to the surrounding environment (noted generally by the arrows in FIG. 3).

Although voltage regulators, such as a powerstat, can be utilized with the present invention, I prefer to size the length and width of path 16 so as to obviate such additional material cost. Thus, with preselection of the nominal width and length of path 16, a heating element 10 having a desired power input (expressed in terms of the units "watts") or heat output (expressed in terms of units "BTU") can be provided. For example, for an element 10 having a rated input of 500 watts at 115 V.A.C., the following relationship exists:

$$\frac{(115\text{ volts})^2}{\text{watts}} = \text{resistance},$$

thus:

$$\frac{(115\text{ volts})^2}{500} = 26.5\text{ ohms}$$

Accordingly, for a rated 500 watt element at 115 V.A.C., path 16 should be sized to exhibit a resistance of about 26.5 ohms.

While the present invention has been discussed in terms of electric space heaters, those in the art may appreciate other areas to which the advantageous features of the present invention can be applied. It is conceivable that the present invention can be adapted to serve as a stove, for example, having hidden "burners" so as to provide a visually and aesthetically appealing countertop.

Accordingly, while the present invention has been herein described in what is presently conceived to be the most preferred embodiment thereof, those in the art may realize that modifications may be made thereto, which modifications shall be accorded the broadest interpretation of the appended claims so as to encompass all equivalent structures, assemblies, methods and/or processes.

What is claimed is:

1. An element for generating heat energy by the application of electrical energy thereto comprising:

an electrically nonconductive substrate;

an electrically nonconductive ceramic material coated on at least one surface of said substrate, said ceramic material containing finely divided metallic particles dispersed therein; and means establishing a burnished path on the surface of said ceramic material to render said ceramic material electrically conductive along said path so that when said electrical energy is applied to said path, current will be conducted along said path and heat will be generated by virtue of the electrical resistance thereof.

2. An element as in claim 1 further comprising electrical connection means adapted for electrically interconnecting said path to a source of electrical energy so that electrical current will flow along said path when interconnected to said electrical energy source.

3. An element as in claim 1 or 2, wherein said ceramic material is formed by firing an aqueous binder solution at elevated temperature.

4. An element as in claim 3, wherein said aqueous binder solution comprises a powder containing aluminum, aluminum phosphate, a soluble chromium compound and an organic amine compound.

5. An element as in claim 1 wherein said substrate is substantially planar.

6. In an electrically operable space heater, at least one element for generating heat energy by the application of electrical energy thereto comprising:

an electrically nonconductive substrate;

an electrically nonconductive ceramic material coated on at least one surface of said substrate, said ceramic material containing finely divided metallic particles dispersed therein; and means establishing a burnished path on the surface of said ceramic material to render said ceramic material electrically conductive along said path so that when said electrical energy is applied to said path, current will be conducted along said path and heat will be generated by virtue of the electrical resistance thereof.

7. In a space heater as in claim 6, said at least one element further comprising electrical connection means adapted for electrically interconnecting said path to a source of electrical energy so that electrical current will flow along said path when interconnection to said electrical energy source.

8. In a space heater as in claim 6, wherein ceramic material is formed by firing an aqueous binder solution at elevated temperature.

9. In a space heater as in claim 15, wherein said aqueous binder solution comprises a powder containing aluminum, aluminum phosphate, a soluble chromium compound and an organic amine compound.

10. In a space heater as in claim 8 wherein said substrate is substantially planar.

11. In a space heater as in claim 6 or 10 wherein plural elements are provided and wherein said space heater includes means for mounting said plural elements substantially parallel to one another.

* * * * *